United States Patent [19]

Kasper et al.

[11] Patent Number: 4,993,104

[45] Date of Patent: Feb. 19, 1991

[54] ELECTRICAL SAFETY INTERLOCK AND PULSE-TYPE RESET CIRCUIT FOR A VACUUM CLEANER SYSTEM

[75] Inventors: Gary A. Kasper, Cadillac; Jeffrey R. Kassien, LeRoy; Dean R. Rohn, Cadillac, all of Mich.

[73] Assignee: Rexair, Inc., Cadillac, Mich.

[21] Appl. No.: 392,826

[22] Filed: Aug. 11, 1989

[51] Int. Cl.[5] ..... A47L 9/28

[52] U.S. Cl. ..... 15/319; 15/339; 15/377; 318/447

[58] Field of Search ..... 15/319, 339, 377; 318/447

[56] References Cited

U.S. PATENT DOCUMENTS

| | | | |
|---|---|---|---|
| 1,370,004 | 3/1921 | Chubb . | |
| 2,839,709 | 6/1958 | Baumgartner et al. | 317/9 |
| 3,303,404 | 2/1967 | Raub, Jr. | 318/447 |
| 3,319,282 | 5/1967 | MacFarland | 15/319 |
| 4,316,304 | 2/1982 | Parise et al. | 15/339 |
| 4,336,626 | 6/1982 | Hone et al. | 15/339 |
| 4,398,316 | 8/1983 | Scott et al. | 15/339 X |
| 4,654,924 | 4/1987 | Getz et al. | 15/319 |
| 4,687,906 | 8/1987 | Fujishima et al. | 219/364 |
| 4,905,343 | 3/1990 | Jailor | 15/339 X |

*Primary Examiner*—Chris K. Moore

*Attorney, Agent, or Firm*—Harness, Dickey & Pierce

[57] ABSTRACT

A safety interlock circuit for a vacuum cleaner system is disclosed for interrupting the flow of current through conductors of a vacuum hose and handle assembly whenever an electrical attachment accessory is disconnected from the handle assembly during operation of the vacuum. A pulse-type reset circuit is also disclosed for re-enabling current flow through the conductors of the vacuum hose and handle assembly after the electrical attachment accessory has been reattached to the handle assembly. The safety interlock circuit of the preferred embodiment comprises a relay coil, a plurality of normally open relay contacts, and a current sensing resistor, all connected in series with an AC power source and a motor of the electrical attachment accessory. A voltage doubler is also connected in parallel with the current sensing resistor for supplying a DC voltage to the relay coil. The safety interlock circuit operates to interrupt current flow by opening the normally open relay contacts whenever the relay coil is de-energized. The pulse-type reset circuit comprises a momentary contact pushbutton reset switch, a plurality of transistors, a capacitor, and a plurality of optical-electrical coupling devices. The pulse-type reset circuit operates to supply a pulse of current to the relay coil to temporarily energize the relay coil to thereby close the normally open relay contacts, thereby allowing current flow through the current sensing resistor and allowing the voltage doubler to apply a voltage across the relay coil to sustain operation of the motor.

37 Claims, 2 Drawing Sheets

ELECTRICAL SAFETY INTERLOCK AND PULSE-TYPE RESET CIRCUIT FOR A VACUUM CLEANER SYSTEM

BACKGROUND OF THE INVENTION

1. Technical Field

This invention relates to wet/dry vacuum cleaner systems and, more particularly, to a safety interlock circuit for interrupting current to a motor located in a wand mounted accessory of the system.

2. Discussion

Wet/dry vacuum cleaner systems are used in a variety of cleaning applications to clean a variety of upholstered objects and surfaces. To better accomplish this task, vacuum units often employ a motorized beater brush attachment unit that connects to an accessory wand of such a vacuum cleaner system. The accessory wand is then connected to a handle assembly having a nozzle for receiving one end of the accessory wand, which in turn is connected to a vacuum hose leading to a main vacuum assembly of the system. The beater brush attachment aids in loosening dirt, threads, lint and other debris from carpets.

Since the beater brush attachment is an electrically driven device, it will typically include an insulated electrical cable with an electrical plug on one end that connects to an electrical receptacle mounted in the handle assembly, thereby allowing electrical power to be supplied through insulated electrical wires in the vacuum hose and the handle assembly to the beater brush attachment. Safety problems may exist, however, whenever the beater brush attachment is disconnected from the nozzle handle leaving an exposed "live" electrical receptacle, or when the insulated electrical cable is accidentally cut or broken. Should any water or other liquid cleaning agent come in contact with the receptacle or a broken wire of the electrical cable, or should an operator touch the receptacle opening or wire end, the operator could receive an electrical shock.

One alternative to avoiding this shock hazard is to have a continuous connection from the main vacuum assembly, through the flexible vacuum hose leading to the handle assembly, and to the beater brush attachment attached to the nozzle of the handle assembly. This "continuous connection" arrangement would prevent the possibility of electrical shock because the electrified hose, as well as the beater brush attachment, would be removed and replaced with a non-electrified vacuum hose whenever a different attachment accessory for the vacuum system is to be used. Therefore, no chance of electrical shock will be present since no electricity will be supplied through the alternate, non-electrified vacuum hose.

Although the above arrangement will remove the possibility of electrical shock when the beater brush attachment is removed from the handle assembly and extension wand, the obvious disadvantage is the need to substitute the electrified vacuum hose with a non-electrified hose whenever the beater brush attachment is disconnected in favor of a different attachment accessory. With the wide variety of upholstered surfaces that may be encountered in a single cleaning application and the wide ranging attachment accessories for specific cleaning situations, it is desirable to be able to switch between several attachment accessories quickly, easily and efficiently during a single cleaning task. Having to change vacuum hoses whenever the beater brush attachment is to be used or removed is an inconvenience for the operator and contributes to inefficiency in the use of the vacuum system.

It would therefore be desirable to have a simple, low-cost safety interlock circuit that would operate to automatically shut off electricity through the vacuum hose and to the handle assembly whenever the beater brush attachment is disconnected from the handle assembly. This would avoid the shock hazard that an otherwise "live" electrified hose presents, while allowing the quick, easy and efficient interchange of various nozzle attachment accessories without also having to change to a non-electrified vacuum hose whenever it is desired to use nozzle attachments other than the beater attachment.

SUMMARY OF THE INVENTION

In accordance with the preferred embodiment, a safety interlock circuit is disclosed for use in connection with a vacuum cleaning system. The interlock safety circuit comprises vacuum hose means having a plurality of insulated conductors running therethrough for allowing current flow through the vacuum hose; electrically driven cleaning accessory means attached to the vacuum hose means for facilitating cleaning tasks; detection means for detecting an interruption in current flow to the cleaning accessory means whenever the cleaning accessory means is disconnected from the vacuum hose means; and switching means responsive to the detection means for further interrupting the current flow in the circuit at a predetermined point so as to prevent current from flowing into the vacuum hose means. In the preferred embodiment, a reset means is also included for re-establishing the current flow through the conductors after the current flow has been interrupted by the switching means.

BRIEF DESCRIPTION OF THE DRAWINGS

The various of the present invention will become apparent to one skilled in the art upon reading the following specification and subjoined claims, and by reference to the drawings in which:

FIG. 3 is a schematic diagram of the electrical interlocking safety circuit and the reset circuit for resetting the interlocking safety circuit.

DESCRIPTION OF THE PREFERRED EMBODIMENT

Figure 1:
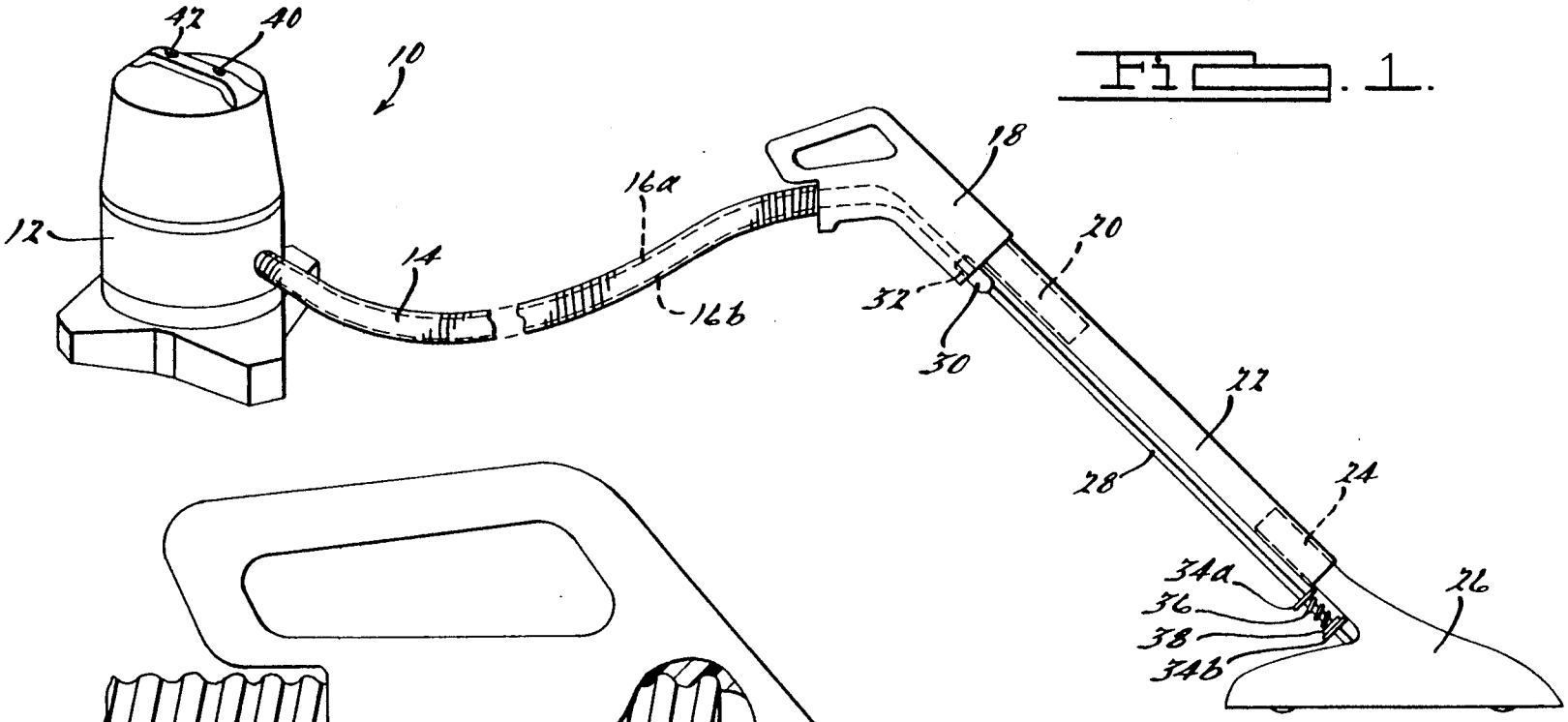
FIG. 1 is an illustration of the basic vacuum system comprising the main vacuum assembly, the vacuum hose, the handle assembly, the beater brush attachment, and the extension wand.

In FIG. 1 there is depicted the basic vacuum system 10. The system 10 comprises a main vacuum assembly 12 which is connected to a flexible vacuum hose 14. The vacuum hose 14 is connected to a handle assembly 18 having a nozzle portion 20 for coupling to an extension wand 22. A pair of insulated conductors **16*a* and 16*b* are further disposed Within the vacuum hose 14 and the handle assembly 18 and run longitudinally through both of those elements, as indicated by the dashed lines marked 16*a* and 16*b*. The extension wand 22 is further coupled to a tubular inlet 24 of a motorized beater brush attachment accessory 26**. It should be understood, however, that while a motorized beater brush attachment is illustrated in FIG. 1, any nozzle accessory requiring electric for its operation will work equally well with the present invention.

The beater brush attachment 26 further includes an insulated electrical connecting cable 28 having a male end plug 30. The male end-plug 30 is illustrated in mating engagement with an electrical female receptacle 32 mounted within the handle assembly 18 (shown in more detail in FIG. 2). The tubular inlet 24 of the beater brush attachment 26 further has attached to it tabs 34*a* and 34*b* which are aperatured to allow passage of the cable 28. A spring 36 circumscribes the cable 28, and is used for biasing a shoulder element 38 attached to the cable 28 against tab 34*b*, thereby holding the cable 28 taut when the cable 28 is connected to the female receptacle 32.

The main vacuum assembly 12 includes a power on-off switch 40 and a reset switch 42, preferably a momentary contact, pushbutton-type switch, for restoring current flow through the conductors 16*a* and 16*b* of the vacuum hose 14, handle assembly 18, and the female receptacle 32 after the male end-plug 30 of the cable 28 has been disconnected from the receptacle 32. The function of the reset switch 42 will be discussed in detail in the following paragraphs.

Figure 2:
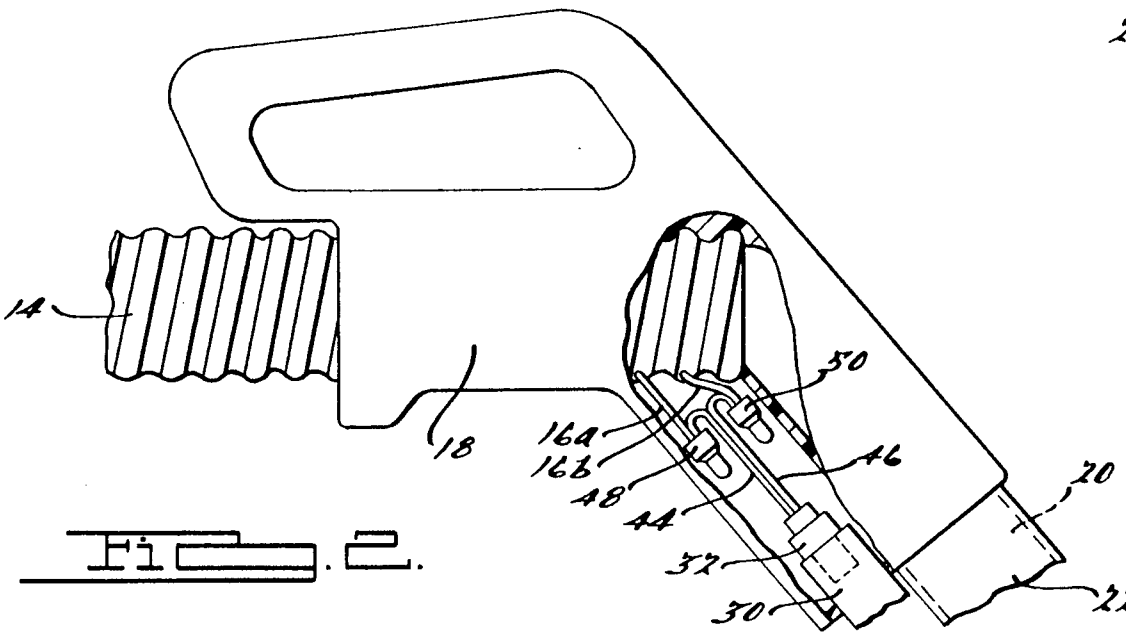
FIG. 2 is an enlarged cut-away view of the handle assembly illustrating more clearly the component parts and female receptacle therein.
Figure 2:
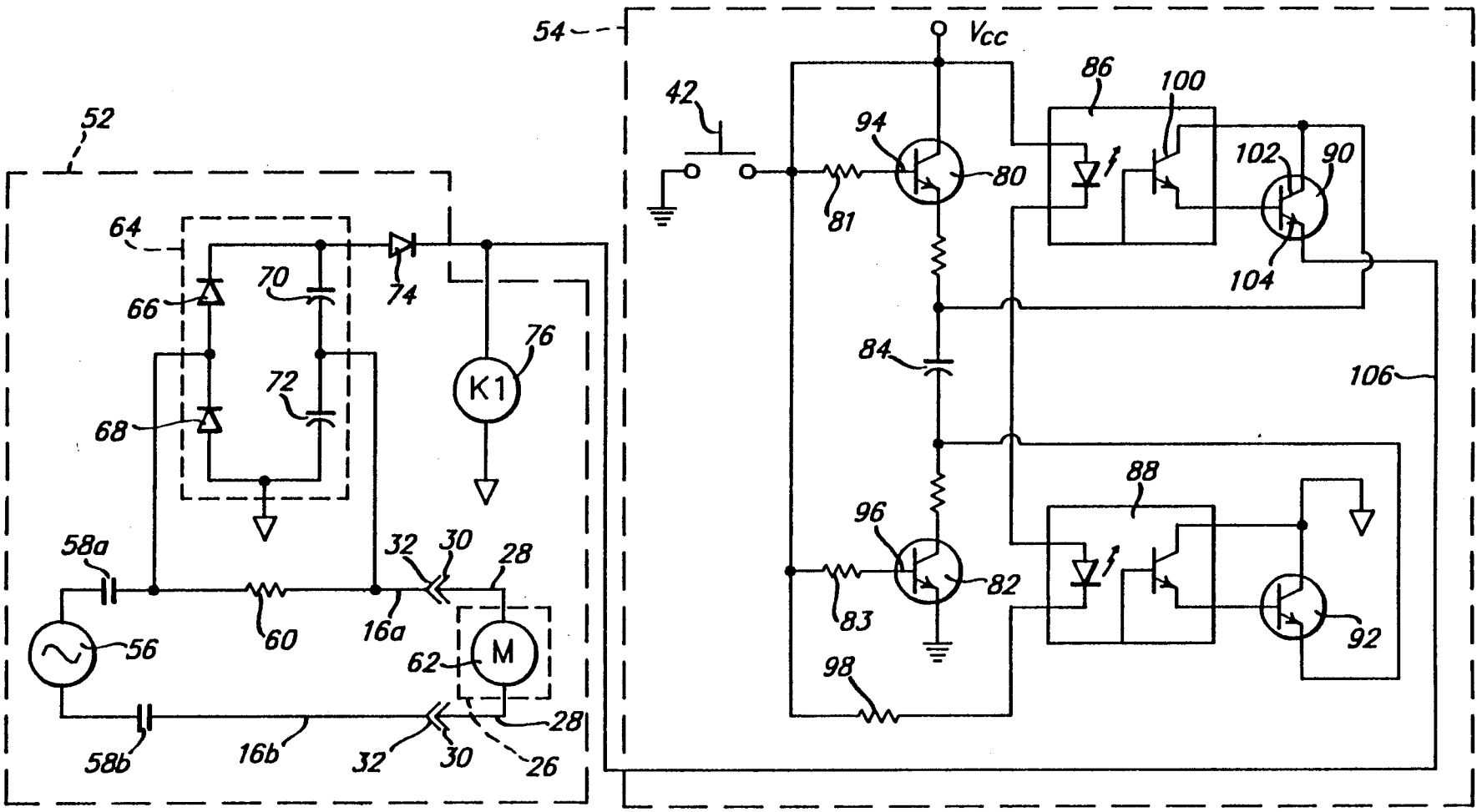

In FIG. 2 an enlarged, cut-away portion of a section of the handle assembly 18 is illustrated to show the electrical interconnections between the first 16*a* and second 16*b* insulated conductors running longitudinally through the hose 14 and handle assembly 18, and first 44 and second 46 insulated receptacle conductors of the female receptacle 32. The first conductor 16*a* from the vacuum hose 14 is spliced via a first splicing nut 48 with the first receptacle conductor 44 from the female receptacle 32. The second conductor 16*b* from the vacuum hose 14 is spliced via a second splicing nut 50 with the second receptacle conductor 46 from the female receptacle 32. Although the splicing arrangement shown in FIG. 2 is a particularly simple and cost effective method for connecting the conductors 16*a* and 16*b* to the conductors 44 and 46 respectively of the female receptacle 32, it should be appreciated that numerous other methods of connecting the conductors could be used by those skilled in the art.

In FIG. 3, a schematic diagram of the safety interlocking circuit 52 for interrupting the flow of current through the vacuum hose 14 of FIGS. 1 and 2 is shown, as is a pulse-type reset circuit 54 for reestablishing current flow in safety interlock circuit 52. Referring first now to the safety interlock circuit 52, a power source 56, which may be a 120 volt AC, 60HZ power source, is connected in series with first and second normally open relay contacts 58*a* and 58*b* acting as first switching means. The relay contacts 58*a* and 58*b* are further connected in series with a current sensing resistor 60, insulated conductors 16*a* and 16*b*, male end plug 30 and female receptacle 32 (represented in FIG. 3 as terminal connections), electrical connecting cable 28, and a motor 62 of the beater brush attachment 26. Connected in parallel with current sensing resistor 60 is a voltage doubler circuit acting as a rectifier means Which is circumscribed by dashed line 64, and which will be referred to throughout the following discussion as voltage doubler 64. The voltage doubler 64, which acts as a rectifier to produce a DC voltage, comprises first and second diodes 66 and 68 connected in a front to back arrangement, and first and second capacitors 70 and 72 also connected in a front to back arrangement. A third diode 74 is also shown connected in parallel with first diode 66 and first capacitor 70 for blocking current flow into the voltage doubler 64. A relay coil 76, which will preferably be a double pole, double throw 3 volt DC, 5 amp relay coil, and which acts as a detection means, is also connected to receive across it the DC voltage produced by the voltage doubler 64. It should be appreciated, however, that other rectifier-type circuits could be substituted for the voltage doubler 64 by those skilled in the art. Furthermore, while a motor of a beater brush attachment has been illustrated as the driving device for the interlock circuit 52 of FIG. 3, it should also be appreciated that the interlock circuit 52 will work equally well with a variety of attachment accessories having a number of electrical driving devices.

In operation, motor 62 will be drawing alternating current through current sensing resistor 60, relay contacts 58*a* and 58*b*, which will be closed during operation of the motor 62, insulated conductors 16*a* and 16*b*, female receptacle 32, male end plug 30, and the electrical connecting cable 28 of the beater brush attachment 26. The voltage drop developed across current limiting resistor 60 during operation of the motor 62 will be applied intermediate first and second diodes 66 and 68 and first and second capacitors 70 and 72 of the voltage doubler 64. The voltage doubler 64 operates to provide approximately double the output voltage of a conventional full-wave rectifier circuit by charging first and second capacitors 70 and 72 during alternating half-cycles of the AC input waveform and then alternately discharging capacitors 70 and 72 in series through third diode 74 and relay coil 76 during alternating half-cycles of the AC input waveform. In this manner, a voltage of roughly double that which would ordinarily be produced by a conventional full-wave rectifier circuit will be applied across the relay coil 76, thereby holding it in an energized state. When relay coil 76 is energized, relay contacts 58*a* and 58*b* will be held in closed positions, thereby allowing current flow to the motor 62.

When male end plug 30 of the electrical connecting cable 28 is disconnected from female receptacle 32, thereby electrically disconnecting motor 62, current flow through the current sensing resistor 60 will be interrupted, thereby interrupting current flow through voltage doubler 64 and the relay coil 76, thus causing relay coil 76 to de-energize. When the relay coil 76 de-energizes, relay contacts 58*a* and 58*b* will change to their normally open states, thus interrupting current flow before the current enters insulated conductors 16*a* and 16*b*.

As was mentioned previously, to re-enable current flow through the safety interlock circuit 52 of FIG. 3, pulse-type reset circuit 54 has been provided as also shown in FIG. 3. The reset circuit 54 includes a momentary contact, pushbutton reset switch 42; first and second NPN transistors 80 and 82 acting as second switching means; a third capacitor 84 for storing an electrical charge; first and second photo diode/photo transistor devices 86 and 88 acting as optical-electrical coupling means; and third and fourth NPN transistors 90 and 92 acting as the third switching means. It should be understood, however, that first and second photo diode/-photo transistor devices 86 and 88 are not essential to the operation of the reset circuit 54, but are merely included to isolate the ground of transistor 82 from the ground of transistor 92, to thereby eliminate any spurious operation of the reset circuit 54 should the ground of transistor 82 float to a different potential from the ground of transistor 92.

Turning now to the operation of reset circuit 54, when reset switch 78 is in the open position, transistors 80 and 82 will be conducting, or turned on, and will charge capacitor 84 and hold it in a charged state. Transistors 90 and 92 will at this time be held in non-conducting modes by coupling devices 86 and 88, which will also be in non-conducting modes. When switch 42 is closed, the bases 94 and 96 of transistors 80 and 82 respectively will be connected to through resistors 81 and 83, as will resistor 98. As a result, transistors 80 and 82 will then turn-off, thereby allowing capacitor 84 to discharge its stored charge in a pulse-like fashion to the collectors 100 and 102 of optical coupling device 86 and transistor 90 respectively. The combination of current flow to the collectors 100 and 102 and voltage supplied by VCC, which will preferably be a regulated +5 volts DC from a conventional +5 volt DC supply, will thus operate to turn on coupling devices 86 and 88 and transistors 90 and 92, thereby allowing the pulse-like, stored charge of capacitor 84 to be discharged and sent via the emitter 104 of transistor 90 and circuit line 106 to the relay coil 76. The pulse-like current flow, which will have a duration of preferably about 10 to 20 milliseconds, will operate to temporarily energize relay coil 76, which will then cause relay contacts **58*a* and 58*b* to change to closed positions, thereby allowing current flow through the current sensing resistor 60. The current flow through current sensing resistor 60 will in turn allow a voltage to be applied to voltage doubler 64, which will then enable voltage doubler 64 to take over and sustain energization of the relay coil 76, thereby re-enabling operation of the motor 62 after capacitor 84** has completely discharged its stored charge.

It should be appreciated that while a pulse-type reset circuit 54 has been disclosed for resetting the safety interlock circuit 52, other types of reset circuits could be readily employed by those skilled in the art to reset safety interlock circuit 52. Also, the duration of the reset pulse produced by reset circuit 54 could easily be adjusted, if needed, by simply changing the capacitance of capacitor 84.

The circuits 52 and 54 of FIG. 3 thus provide a simple, low cost means for de-electrifying the otherwise electrically live hose 14 whenever the beater brush attachment 26 is electrically disconnected via the cable 28 and the male plug 30 from the female receptacle 32. This permits a wide variety of accessory attachments to be interchanged easily, conveniently and safely from the extension wand 22 or nozzle 20 of the handle assembly 18 without incurring the risk of electrical shock that might otherwise be present at the female receptacle 32 when the male end plug 30 is disengaged from the female receptacle 32. The circuits 52 and 54 further provide the safety feature of interrupting current flow through the conductors **16*a* and 16*b* and the handle assembly 18 if the cable 28** is accidentally cut.

The interlocking circuit 52 and reset circuit 54 of FIG. 3 further permit accessory attachments to be quickly, easily and interchangeably attached at the nozzle 20 of the handle assembly 18 or at the extension wand 22 without the need to exchange the electrically "live" hose 14 with a non-electrified hose. This serves to eliminate any possible shock hazard that might otherwise exist when accessory attachments other than the beater brush attachment 26 are being used in connection with the handle assembly 18. As such, a single, current carrying vacuum hose 14 may be used continuously with a wide variety of attachment accessories, thereby promoting easier, less costly and more convenient use of the vacuum system illustrated in FIG. 1.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. An electrical safety interlock circuit for automatically interrupting current flow through a vacuum hose and handle of a vacuum cleaner whenever an electrical cleaning accessory is detached from said handle, said electrical safety interlock circuit comprising:

detection means for detecting an interruption in said current flow to said electrical cleaning accessory when said electrical cleaning accessory is detached from said handle; and switching means responsive to said detection means for further interrupting said current flow through said vacuum hose and said handle whenever said electrical cleaning accessory is detached from said handle.

2. The system of claim 1, further comprising reset means for selectively re-establishing current flow through said vacuum hose and handle to said electrical cleaning accessory.

3. The system of claim 1, wherein said detection means is a relay coil.

4. The system of claim 1, wherein said switching means is a plurality of relay contacts.

5. An electrical interlock safety system comprising:

conductor means for allowing current flow therethrough;

hose means for supporting said conductor means and facilitating cleaning tasks;

cleaning means attachable to said hose means and said conductor, said cleaning means being operable to further facilitate cleaning tasks in response to said current flow from said conductor means;

detection means for detecting an interruption in said current flow to said cleaning means whenever said cleaning means is disconnected from said conductor means; and first switching means responsive to said detection means for further interrupting said current flow through said conductor means whenever said cleaning means is disconnected from said conductor means.

6. The system of claim 5, further comprising reset means for re-establishing said current flow through said conductor means after said current flow has been interrupted by said switching means.

7. The system of claim 6, wherein said reset means comprises:

a reset switch for initiating operation of said reset means;

second switching means responsive to said reset switch for further controlling the operation of said reset means; and third switching means for further controlling the operation of said reset means, said reset switch and said second and third switching means operating cooperatively to provide a reset signal to re-enable said current flow to said cleaning means.

8. The system of claim 7, further comprising optical-electrical coupling means for enhancing operation of said second and third switching means.

9. The system of claim 5, wherein said conductor means is a plurality of insulated conductors running longitudinally through said hose means.

10. The system of claim 5, further comprising:

a female receptacle attached to said conductor means; and a male plug attached to said cleaning means, said male plug being operable to removably engage said female conductor, thereby allowing said current flow to be provided to said cleaning means.

11. The system of claim 5, wherein said hose means is a flexible vacuum hose.

12. The system of claim 5, wherein said cleaning means is a beater brush attachment.

13. The system of claim 5, wherein said detection means is a relay coil.

14. The system of claim 5, wherein said first switching means is a plurality of relay contacts.

15. The system of claim 5, further comprising:

rectifier means for supplying a DC signal to said detection means; and current sensing means for sensing current flow to said cleaning means, whereby an interruption in current flow to said rectifier means interrupts said DC signal to said detection means, thereby causing said switching means to interrupt said current flow through said conductor means.

16. The system of claim 5, further comprising a handle assembly disposed intermediate said hose means and said cleaning means for facilitating operation of said cleaning means.

17. An electrical safety system for a vacuum cleaner, said system comprising:

a main vacuum cleaner assembly;

a vacuum hose having first and second ends, said vacuum hose being attachable at its said first end to said main vacuum cleaner assembly;

a handle assembly attached to said second end of said vacuum hose for facilitating cleaning tasks;

a plurality of insulated, current carrying conductors running longitudinally through said vacuum hose and through said handle assembly;

electrical cleaning accessory means removably attachable to said handle assembly and said insulated, current carrying conductors for further facilitating said cleaning tasks;

first switching means for interrupting current flow through said current carrying conductors when said cleaning accessory means is disconnected from said current carrying conductors;

relay coil means for controlling said first switching means; and current sensing means for sensing when said current flow through said insulated, current carrying conductors has been interrupted and controlling said relay coil means, whereby controlling said relay coil means operates to control said first switching means, thereby further interrupting said current flow through said insulated, current carrying conductors before said current flow enters a portion of said insulated, current carrying conductors in said vacuum hose and said handle assembly.

18. The system of claim 17, further comprising reset means for re-establishing said current flow through said system after said current flow through said vacuum hose and said handle assembly has been interrupted by said relay contacts.

19. The system of claim 17, wherein said first switching means is a plurality of relay contacts.

20. The circuit of claim 17, wherein said current sensing means is a resistor disposed in series with one of said current carrying conductors.

21. The system of claim 17, wherein said relay coil means is a relay coil.

22. The system of claim 17, further comprising rectifier means for producing a DC voltage to operate said relay coil means.

23. The system of claim 22, wherein said rectifier means is a full-wave voltage doubler.

24. The safety system of claim 17, wherein said reset means is a pulse-type reset means comprising:

a reset switch;

charge storing means for generating a pulse-type reset signal;

second switching means for controlling said charge storing means; and third switching means for controlling said reset pulse, said second and third switching means further being responsive to said reset switch, whereby said reset switch operates to control said second and third switching means, said second and third switching means thereby controlling said charge storing means to provide said pulse-type reset signal to restore said current flow through said current carrying conductors.

25. The system of claim 24, wherein said reset switch is a manually operated, momentary contact push button switch.

26. The system of claim 24, further comprising optical-electrical coupling means for further enhancing operation of said reset means.

27. The system of claim 26, wherein said optical-electrical coupling means is a plurality of photo-diode/-photo transistor coupling devices operable to electrically isolate grounds of said second and third switching means, thereby further enhancing operation of said reset means.

28. The system of claim 24, wherein said charge storing means is a capacitor operable to discharge a charge stored therein, thereby producing said pulse-type reset signal.

29. The system of claim 24, wherein said second switching means is a plurality of transistors, said transistors being operable to help facilitate storage and discharge of said charge storing means.

30. The system of claim 24, wherein said third switching means is a plurality of transistors, said transistors being operable to help control said pulse-type reset signal.

31. An electrical safety system for a vacuum cleaner, said system comprising:

a main vacuum cleaner assembly;

a vacuum hose having first and second ends, said vacuum hose being attachable at its said first end to said main vacuum cleaner assembly;

a handle assembly attached to said second end of said vacuum hose for facilitating cleaning tasks;

a plurality of insulated, current carrying conductors running longitudinally through said vacuum hose and through said handle assembly;

electrical cleaning accessory means removably attachable to said handle assembly and said insulated, current carrying conductors for further facilitating said cleaning tasks;

first switching means for interrupting current flow through said current carrying conductors when said cleaning accessory means is disconnected from said current carrying conductors;

relay coil means for controlling said first switching means;

current sensing means for sensing when said current flow through said insulated, current carrying conductors has been interrupted and controlling said relay coil means, whereby controlling said relay coil means operates to control said first switching means, thereby further interrupting said current flow through said insulated, current carrying conductors before said current flow enters a portion of said insulated, current carrying conductors in said vacuum hose and said handle assembly; and reset means for supplying a reset signal to said relay coil means to thereby reset said first switching means and allow said current flow through said insulated, current-carrying conductors to be re-established after said current flow has been interrupted.

32. An electrical safety system for a vacuum cleaner, said system comprising:

a main vacuum cleaner assembly;

a vacuum hose having first and second ends, said vacuum hose being attachable at its said first end to said main vacuum cleaner assembly;

a handle assembly attached to said second end of said vacuum hose for facilitating cleaning tasks;

a plurality of insulated, current-carrying conductors running longitudinally through said vacuum hose and through said handle assembly;

electrical cleaning accessory means removably attachable to said handle assembly and said insulated, current carrying conductors for further facilitating said cleaning tasks;

a plurality of relay contacts for interrupting current flow through said current carrying conductors when said cleaning accessory means is disconnected from said current carrying conductors;

a relay coil for controlling said relay contacts;

a current sensing resistor for sensing when said current flow through said insulated, current carrying conductors has been interrupted and controlling said relay coil, whereby controlling said relay coil operates to control said relay contacts, thereby further interrupting said current flow through said insulated, current carrying conductors before said current flow enters a portion of said insulated, current carrying conductors in said vacuum hose and said handle assembly;

a manually operated, momentary contact push button reset switch;

a plurality of first transistors responsive to said manually operated, momentary contact, push button reset switch;

a capacitor operable to store and discharge a charge in response to operation of said plurality of first transistors;

a plurality of second transistors for further controlling storage and discharge of said capacitor;

coupling means for isolating said first and second transistors to thereby enhance operation of said first and second transistors; and whereby actuation of said manually operated, momentary contact push button reset switch operates to switch said plurality of first transistors, thereby allowing said capacitor to discharge a charge stored therein to produce a pulse-type reset signal, said pulse-type reset signal being operable to switch said optical-electrical coupling devices and said plurality of second transistors to conducting states, thereby allowing said pulse-type reset signal to be applied to said relay coil, thereby temporarily energizing said relay coil to thereby re-enable operation of said cleaning accessory means after said current flow to said cleaning accessory means has been interrupted by said relay contacts.

33. An electrical safety interlock circuit for a vacuum cleaner system for automatically detecting a first resistance condition within said circuit associated with an uncoupling of an electrically driven cleaning tool from a handle assembly of said vacuum cleaner system, and a second resistance condition associated with the coupling of said electrically driven cleaning tool with said handle assembly, said safety interlock circuit comprising:

a handle assembly having electrical coupling means for electrically coupling said electrically driven cleaning tool with said handle assembly;

detection means for detecting said first resistance condition within said interlock circuit generated when said electrically driven cleaning tool is uncoupled from said handle assembly and said second resistance condition when said electrically driven cleaning tool is coupled with said handle assembly; and switching means responsive to said detection means for interrupting current flow to said electrical coupling means when said first resistance condition is generated, said switching means further being operable to enable current flow to said electrical coupling means in response to detection of said second resistance condition.

34. The system of claim 33, wherein said first resistance condition comprises a high resistance condition.

35. The system of claim 33, wherein said second resistance condition comprises a low resistance condition.

36. The system of claim 33, wherein said detection means comprises a resistor operable to provide an indication of said first resistance condition when said electrically driven cleaning tool is uncoupled from said handle assembly, and operable to provide an indication of said second resistance condition when said electrically driven cleaning tool is coupled to said handle assembly.

37. The system of claim 33, wherein said switching means comprises:

relay coil means responsive to said first and second resistance conditions indicated by said resistor for generating a contact de-energization signal; and relay contact means responsive to said contact de-energization signal for interrupting current flow to said electrical coupling means of said handle assembly when said electrically driven cleaning tool is uncoupled from said handle assembly.

* * * * *